US010529291B2

(12) United States Patent
Tien et al.

(10) Patent No.: US 10,529,291 B2
(45) Date of Patent: Jan. 7, 2020

(54) DUAL GAMMA DISPLAY PANEL

(71) Applicant: AU Optronics Corporation, Hsin-Chu (TW)

(72) Inventors: Kun-Cheng Tien, Hsin-Chu (TW); Chien-Huang Liao, Hsin-Chu (TW); Jia-Long Wu, Hsin-Chu (TW); Wen-Hao Hsu, Hsin-Chu (TW); Yung-Jen Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/257,072

(22) Filed: Sep. 6, 2016

(65) Prior Publication Data

US 2017/0116934 A1 Apr. 27, 2017

(30) Foreign Application Priority Data

Oct. 26, 2015 (TW) ..... 104135109 A

(51) Int. Cl.
*G09G 3/36* (2006.01)

(52) U.S. Cl.
CPC ..... *G09G 3/3607* (2013.01); *G09G 3/364* (2013.01); *G09G 3/3614* (2013.01); *G09G 3/3685* (2013.01); *G09G 3/3648* (2013.01); *G09G 3/3655* (2013.01); *G09G 2310/027* (2013.01); *G09G 2320/0209* (2013.01); *G09G 2320/0242* (2013.01); *G09G 2320/0276* (2013.01); *G09G 2320/0673* (2013.01); *G09G 2320/0686* (2013.01)

(58) Field of Classification Search
CPC .... G09G 3/3607; G09G 3/3614; G09G 3/364; G09G 3/3685
See application file for complete search history.

(56) References Cited

U.S. PATENT DOCUMENTS 6,061,045 A * 5/2000 Inaba ..... G09G 3/364 345/95
8,405,593 B2 3/2013 Liu et al.
8,416,232 B2 4/2013 Nam et al.
8,810,490 B2 8/2014 Moon et al.
(Continued)

FOREIGN PATENT DOCUMENTS

CN 101800035 A 8/2010
CN 102138098 A 7/2011
(Continued)

OTHER PUBLICATIONS

State Intellectual Property Office of the People's Republic of China , "Office Action", dated Sep. 20, 2017.
China Patent Office "Office Action" dated May 18, 2018, China.

*Primary Examiner* — Sejoon Ahn
(74) *Attorney, Agent, or Firm* — WPAT, PC

(57) ABSTRACT

A display panel includes a driver, X data lines, Y scan lines, and X*Y pixels. The driver is configured to receive display data with X*Y resolution. The X data lines are electrically connected to the driver and configured to receive a plurality of pixel voltages. The X*Y pixels are electrically connected to the data lines and the scan lines. When each gray level of a first color display data set is identical and lower than a first threshold value, the pixel voltages of the plurality of first color subpixels are not identical.

19 Claims, 12 Drawing Sheets

(56) References Cited

U.S. PATENT DOCUMENTS 8,847,937 B2 9/2014 Lee et al.
2003/0055591 A1* 3/2003 Whittington ..... G09G 3/006 702/108
2006/0221029 A1* 10/2006 Hsu ..... G09G 3/3614 345/88
2006/0221030 A1* 10/2006 Shih ..... G09G 3/3611 345/88
2007/0001965 A1 1/2007 Lee
2007/0075951 A1* 4/2007 Lin ..... G09G 3/3648 345/89
2008/0224982 A1* 9/2008 Yamazaki ..... G09G 3/3688 345/98
2008/0278429 A1* 11/2008 Chen ..... G09G 3/3655 345/98
2009/0279007 A1 11/2009 Shih et al.
2009/0322798 A1* 12/2009 Lin ..... G09G 3/2074 345/690
2011/0096058 A1 4/2011 Nakahata et al.
2012/0194567 A1* 8/2012 Lee ..... G09G 3/3648 345/690
2012/0200553 A1 8/2012 Wu et al.
2015/0035878 A1* 2/2015 Zhu ..... G09G 3/3648 345/694
2016/0335944 A1 11/2016 Kang et al.

FOREIGN PATENT DOCUMENTS

CN 103854616 A 6/2014
CN 104183221 A 12/2014
CN 104299592 A 1/2015
CN 105304007 A 2/2016
TW I334502 12/2010

* cited by examiner

| D1 | D2 | D3 | D4 | D5 | D6 | D7 | D8 |
|---|---|---|---|---|---|---|---|
| (m) | (s) | (m) | (s) | (m) | (s) | (m) | (s) |
| + | + | − | − | + | + | − | − |

| D1 | D2 | D3 | D4 | D5 | D6 | D7 | D8 |
|---|---|---|---|---|---|---|---|
| (m) | (s) | (m) | (s) | (m) | (s) | (m) | (s) |
| + | − | − | + | − | + | + | − |

| D1 | D2 | D3 | D4 | D5 | D6 | D7 | D8 |
|---|---|---|---|---|---|---|---|
| (m) | (s) | (m) | (s) | (m) | (s) | (m) | (s) |
| + | + | + | + | − | − | − | − |

DUAL GAMMA DISPLAY PANEL

CROSS-REFERENCE TO RELATED APPLICATIONS

This application claims priority to Taiwan Patent Application No. 104135109 filed in the Taiwan Patent Office on Oct. 26, 2015, the entire content of which is incorporated herein by reference.

BACKGROUND OF THE DISCLOSURE

This application relates to a display technology, and in particular, to a display panel.

In order to solve the side-view color washout problem of a display apparatus, a single subpixel of the display apparatus is usually divided into two areas, and appropriate circuitry is applied to drive the two areas of the single subpixel with different pixel voltages. With this arrangement, the single subpixel displays two different gray level-to-brightness curves, which serves to alleviate the color washout problem.

In order to meet consumer expectations of picture clarity, high resolution is a design goal in the development of a display apparatus. However, if the foregoing single subpixel area division technology is adopted in a display apparatus with high resolution, transmittance of the display apparatus is reduced.

BRIEF SUMMARY OF THE DISCLOSURE

One objective of the disclosure is to provide a display panel, so as to solve the aforementioned problem.

To achieve this objective, one technical aspect of the disclosure relates to a display panel, where the display panel includes a driver, X data lines, Y scan lines, and X*Y pixels. The driver is configured to receive display data with X*Y resolution, the X data lines are electrically connected to the driver and are configured to receive a plurality of pixel voltages, the X*Y pixels are electrically connected to the data lines and the scan lines, and when all gray levels of a first color display data set happen to be identical to one another and lower than a first threshold value, the pixel voltages of the corresponding plurality of first color pixels are nevertheless not identical.

Note that various features and elements in the figures are not necessarily drawn proportionally; rather, the drawings endeavor to present specific features and elements related to this application with optimal clarity. Identical or similar element symbols are used to indicate similar elements/components between different figures.

DETAILED DESCRIPTION OF THE DISCLOSURE

In order to make the description of this disclosure more comprehensive, implementation aspects and specific embodiments of the present disclosure are illustratively described below, but are not intended to be the sole means or form of implementing or applying the specific embodiments of the present disclosure. Implementation manners cover features of a plurality of specific embodiments, and method steps and a sequence thereof used for constructing and operating the specific embodiments. However, other specific embodiments may be also used to achieve the same or equivalent function and sequence of steps.

Unless otherwise defined in this specification, meanings of scientific and technical terms used herein are the same as the common meanings that are understood by a person of ordinary skill in the art. Use of a singular noun used in this specification covers a plural form of the noun, and a plural noun also covers a singular form of the noun, except when such interpretation would give rise to a contextual conflict.

Figure 1A:
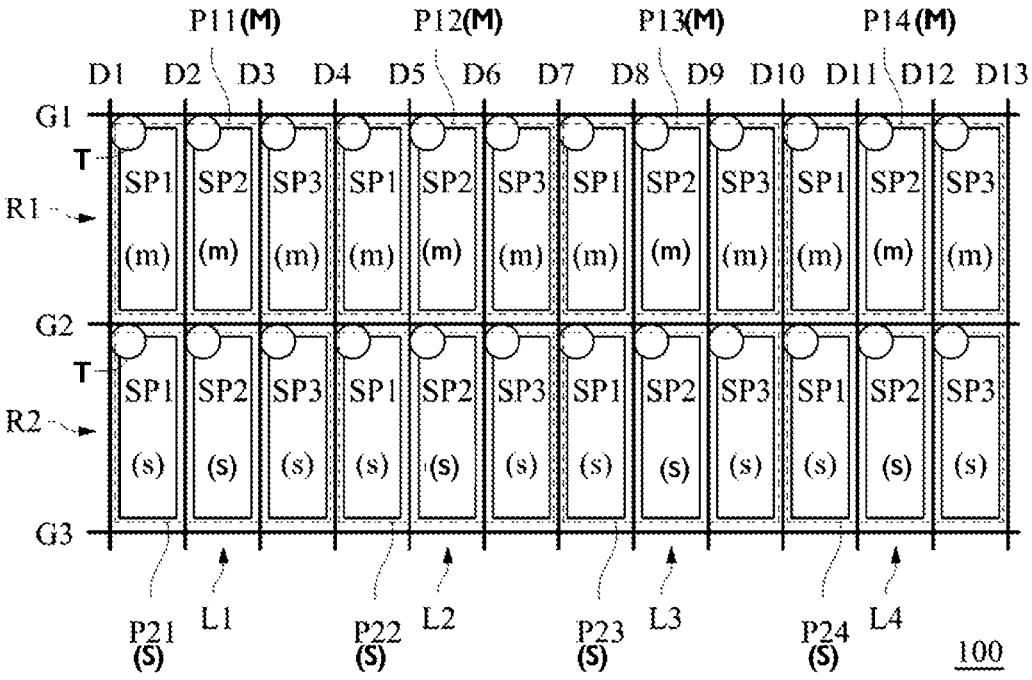
FIG. 1A is a schematic diagram of a display panel according to an embodiment of the disclosure.

FIG. 1A is a schematic diagram of a display panel according to an embodiment of the present disclosure. The display panel 100 includes a driver (not shown in the figure), 3*X data lines D1 to Dx, Y scan lines G1 to Gy, and X*Y pixels P11 to Pxy. The X and Y are positive integers. Each pixel includes a first color subpixel SP1, a second color subpixel SP2 and a third color subpixel SP3. Furthermore, each pixel includes a switch T electrically connecting to the data line and scan line respectively. The driver is configured to receive display data with X*Y resolution; the 3*X data lines D1 to Dx are electrically connected to the driver and are configured to receive a plurality of pixel voltages; the X*Y pixels P11 to Pxy are electrically connected to the data lines D1 to Dx and the scan lines G1 to Gy; and when all gray levels of a first color display data set happen to be identical to one another and lower than a first threshold value, the pixel voltages of the corresponding plurality of first color sub-pixels are nevertheless not identical.

The disclosure uses a driver to enable, when all gray levels of a first color display data set happen to be identical to one another and lower than a first threshold value, the pixel voltages of the corresponding plurality of first color pixels are nevertheless not identical, thereby alleviating the color washout problem. An original structure of a pixel does not need to be changed in the display panel 100 of the embodiment of the disclosure. Therefore, as compared with the prior art, the disclosure improves transmittance of a display panel.

Figure 1B:
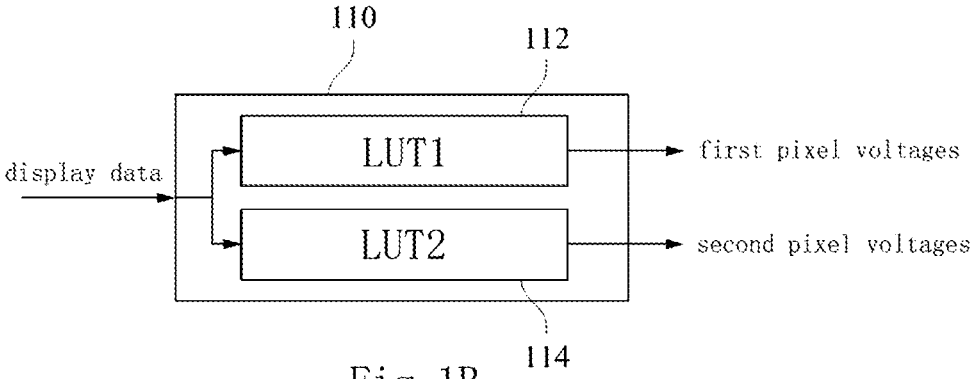
FIG. 1B is a schematic diagram of a driver of a display panel according to another embodiment of the disclosure.

FIG. 1B is a schematic diagram of a driver of a display panel according to another embodiment of the disclosure. As shown in the figure, a driver 110 includes a first gamma lookup table (LUT1) 112 and a second gamma lookup table (LUT2) 114. In operation, the first gamma lookup table (LUT1) 112 is configured to separately receive the display data and provide a plurality of first pixel voltages. The second gamma lookup table (LUT2) 114 is configured to separately receive the display data and provide a plurality of second pixel voltages. Therefore the driver 110 produces a first pixel voltage and a second pixel voltage corresponding to each gray level in the display data. In the embodiment shown in FIG. 1A, a pixel in an odd row receives one of the first pixel voltages, and a pixel in an even row receives one of the second pixel voltages. For example, a pixel in a first row R1 receives one of the first pixel voltages, and a pixel in a second row R2 receives one of the second pixel voltages. As compared with the prior art in which a single subpixel is divided into two areas, the present disclosure, rather than changing an original structure of a pixel, instead uses two pixels that are located at a same column and at two adjacent rows. These two adjacent pixels in column direction are regarded as a main pixel M and a secondary pixel S. For example, a pixel in the first row R1 is regarded as a main pixel M, and a pixel in the second row R2 is regarded as a secondary pixel S, and the driver 110 separately provides a first pixel voltage to the main pixel M and a second pixel voltage to the secondary pixel S, so as to enable the two pixels to display with different voltage-to-brightness curves, thereby alleviating the color washout problem. Furthermore, the pixels in the first row R1 and the pixels in the second row R2 at the same column receive pixel voltages corresponding to different display data. For example, the pixel P11 receives the first pixel voltage corresponding to a first display data and the pixel P21 receives the second pixel voltage corresponding to a second display data. In other words, any pixel receiving the first pixel voltage is regards as main pixel M and any pixel receiving the second pixel voltage is regards as secondary pixel S.

Figure 1C:
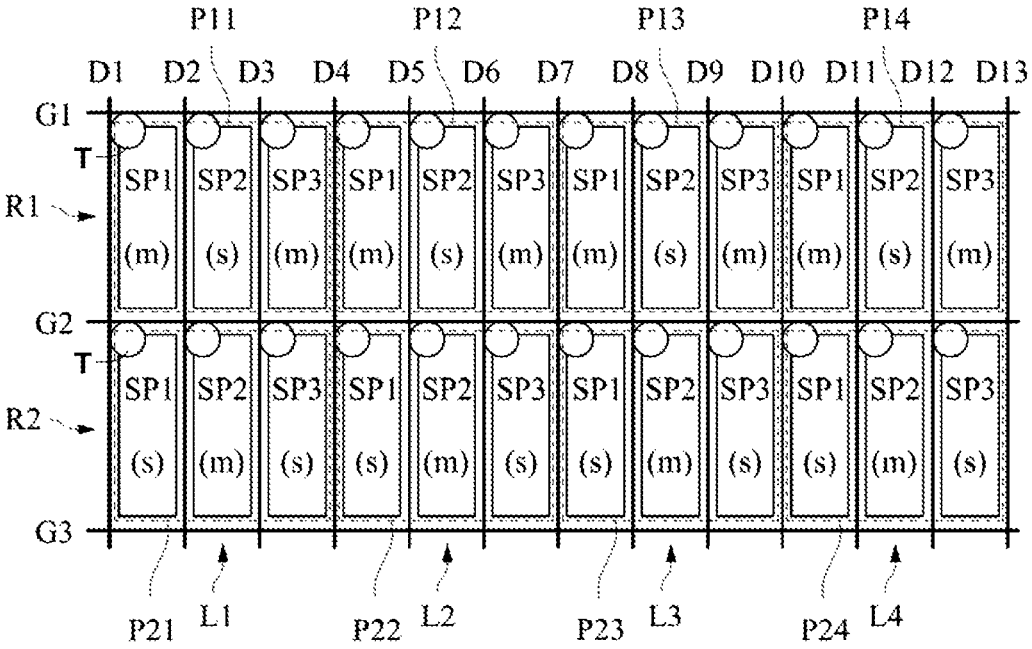
FIG. 1C is a schematic structural diagram of a display panel according to yet another embodiment of the disclosure.

FIG. 1C is a schematic structural diagram of a display panel according to another embodiment of the disclosure. Each of the X*Y pixels P11 to Pxy shown in FIG. 1A includes a first color subpixel SP1, a second color subpixel SP2, and a third color subpixel SP3; the first color subpixels SP1 and the third color subpixels SP3 in odd rows receive first pixel voltages; the second color subpixels SP2 in the odd rows receive second pixel voltages; the first color subpixels SP1 and the third color subpixels SP3 in even rows receive the second pixel voltages; and the second color subpixels SP2 in the even rows receive the first pixel voltages. As compared with the prior art in which a single subpixel is divided into two areas, rather than change an original structure of a subpixel, the disclosure uses two subpixels located in two adjacent rows as the main subpixel m and a secondary subpixel s, and a driver 110 separately provides a first pixel voltage and a second pixel voltage to the main subpixel m and the secondary subpixel s, so as to enable the two subpixels to be displayed with different brightnesses, thereby alleviating the color washout problem.

Figure 2A:
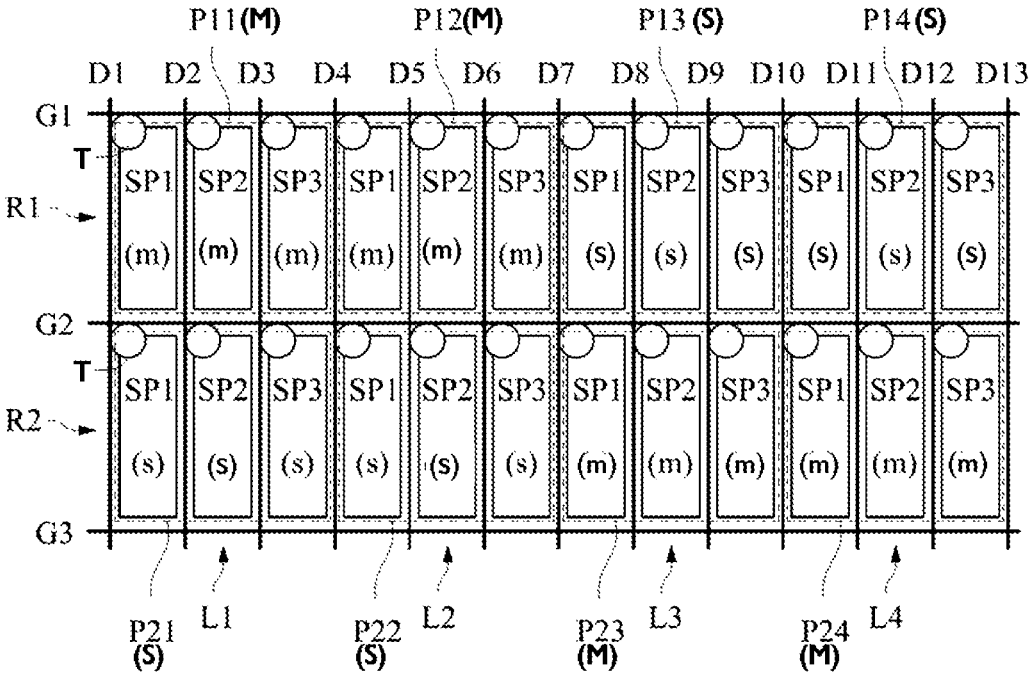
FIG. 2A is a schematic diagram of a display panel according to still another embodiment of the disclosure.

FIG. 2A is a schematic diagram of a display panel according to yet another embodiment of the disclosure. As shown in the figure, X*Y pixels P11 to Pxy include a first pixel and a second pixel adjacent to each other; the first pixel and the second pixel receive a first pixel voltage; and other pixels adjacent to the first pixel and the second pixel receive a second pixel voltage. For example, X*Y pixels P11 to Pxy include a pixel P11 and a pixel P12 adjacent to each other; the pixel P11 and the pixel P12 receive a first pixel voltage; and other pixels (such as pixels P13, P21, and P22) adjacent to the pixel P11 and the pixel P12 receive a second pixel voltage. Furthermore, any pixel receiving the first pixel voltage is regards as main pixel M and any pixel receiving the second pixel voltage is regards as secondary pixel S. Further referring to FIG. 2A, a first pixel P11 and a second pixel P12 in a first row R1 separately receive the first pixel voltage; a third pixel P13 and a fourth pixel P14 in the first row R1 separately receive the second pixel voltage; a first pixel P21 and a second pixel P22 in a second row R2 separately receive the second pixel voltage; a third pixel P23 and a fourth pixel P24 separately receive the first pixel voltage; and the display panel is expanded according to pixel arrays of the foregoing pixels P11 to P24.

Figure 2B:
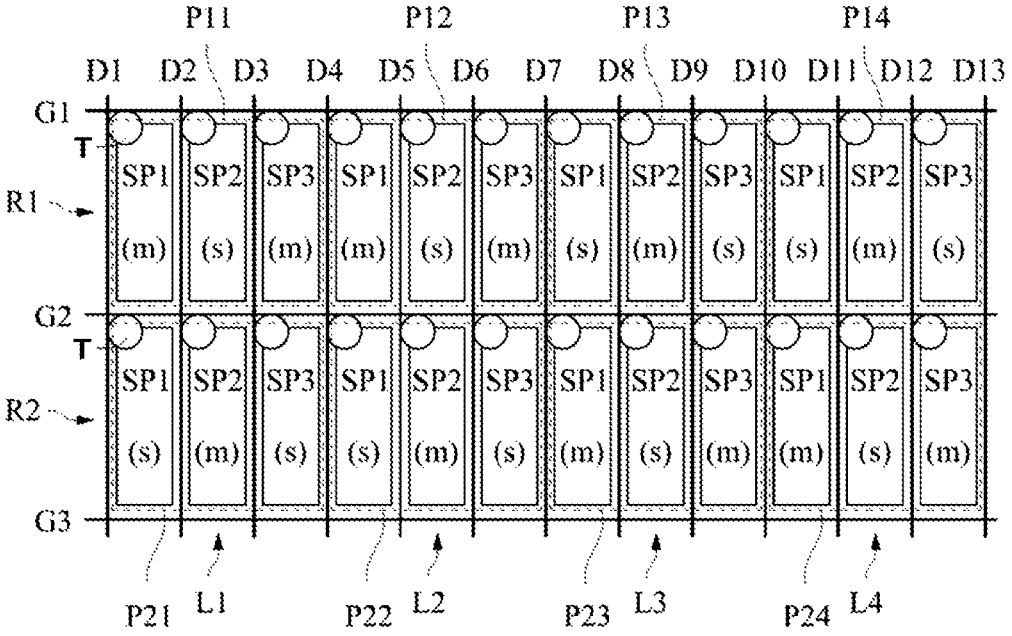
FIG. 2B is a schematic structural diagram of a display panel according to another embodiment of the disclosure.

FIG. 2B is a schematic structural diagram of a display panel according to still another embodiment of the disclosure. Each of X*Y pixels P11 to Pxy includes a first color subpixel SP1, a second color subpixel SP2, and a third color subpixel SP3; the first color subpixels SP1 and the third color subpixels SP3 receive a voltage from either the first pixel voltages or the second pixel voltages, and the second subpixels SP2 receive a voltage from the other of the first pixel voltages and the second pixel voltages. In other words, any subpixel receiving the first pixel voltage is regards as main subpixel m and any subpixel receiving the second pixel voltage is regards as secondary subpixel s. For example, first color subpixels SP1 and third color subpixels SP3 in a pixel P11 and a pixel P12 receive first pixel voltages, and second color subpixels SP2 receive second pixel voltages; first color subpixels SP1 and third color subpixels SP3 in a pixel P13 and a pixel P14 receive the second pixel voltages, and second color subpixels SP2 receive the first pixel voltages; first color subpixels SP1 and third color subpixels SP3 in a pixel P21 and a pixel P22 receive the second pixel voltages, and second color subpixels SP2 receive the first pixel voltages; first color subpixels SP1 and third color subpixels SP3 in a pixel P23 and a pixel P24 receive the first pixel voltages, and second color subpixels SP2 receive the second pixel voltages; and the display panel is expanded according to pixel arrays of the foregoing pixels P11 to P24. In other words, one of any two adjacent subpixels in a same column receives a voltage from the first pixel voltages, and the other subpixel receives a voltage from the second pixel voltages.

Figure 3A:
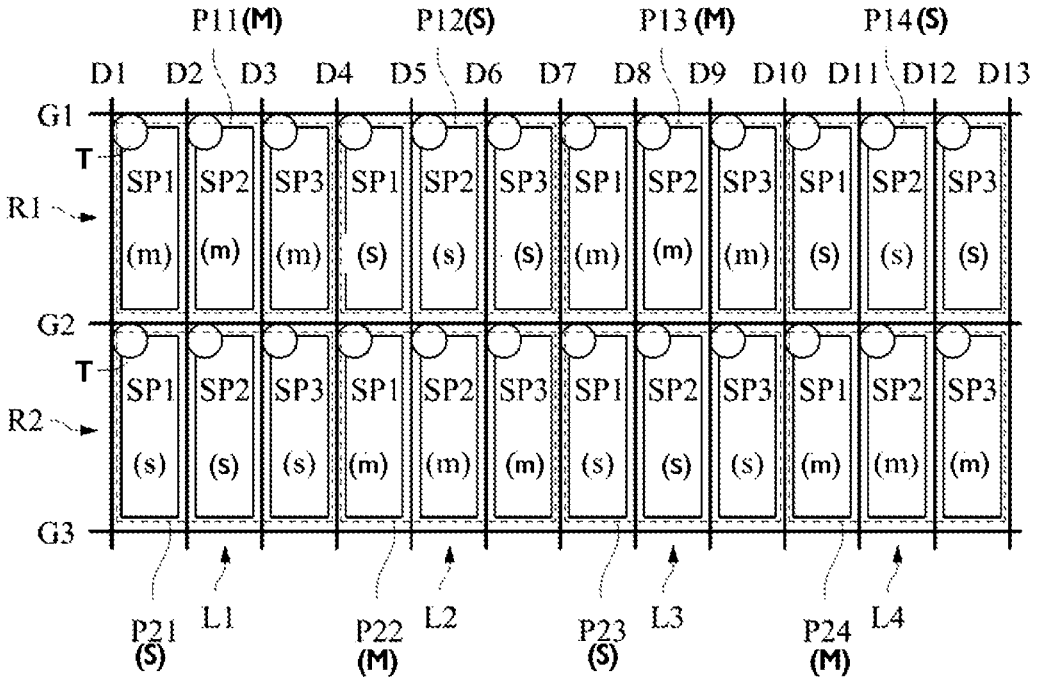
FIG. 3A is a schematic diagram of a display panel according to yet another embodiment of the disclosure.

FIG. 3A is a schematic diagram of a display panel according to another embodiment of the disclosure. As shown in the figure, X*Y pixels P11 to Pxy include a first pixel and a second pixel adjacent to each other; the first pixel receives a voltage from the first pixel voltages; and the second pixel receives a voltage from the second pixel voltages. For example, X*Y pixels P11 to Pxy include a pixel P11 and a pixel P12 adjacent to each other; the pixel P11 receives a voltage from the first pixel voltages, and the pixel P12 receives a voltage from the second pixel voltages; a pixel P21 adjacent to the pixel P11 receives a voltage from the second pixel voltages, and a pixel P22 adjacent to the pixel P12 receives a voltage from the first pixel voltages; and the display panel is expanded according to pixel arrays of the foregoing pixels P11 to P22.

Figure 3B:
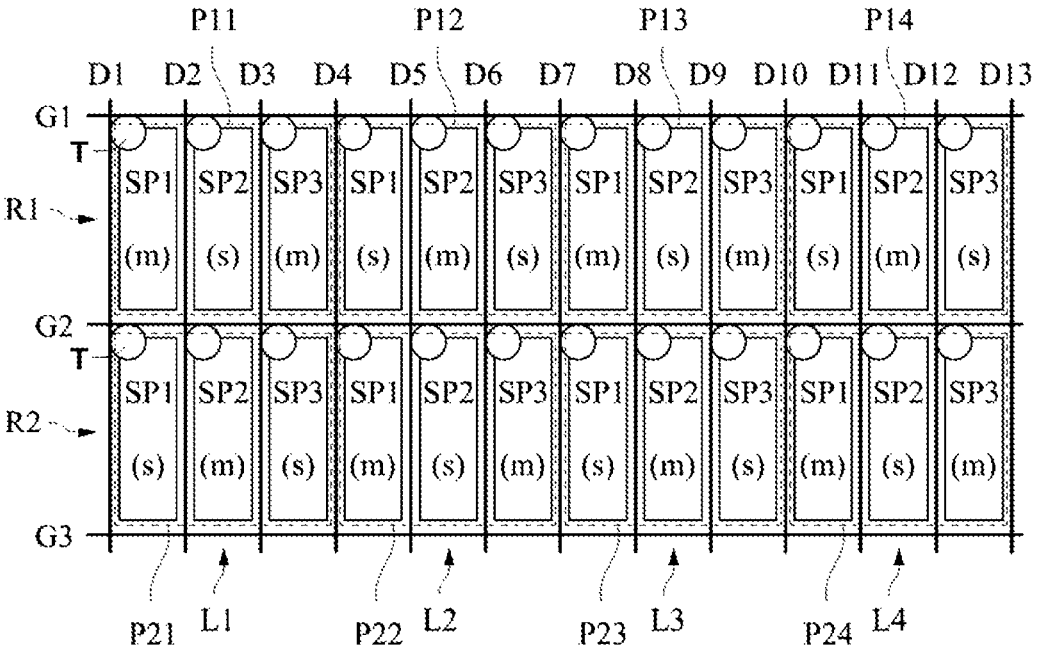
FIG. 3B is a schematic structural diagram of a display panel according to still another embodiment of the disclosure.

FIG. 3B is a schematic structural diagram of a display panel according to yet another embodiment of the disclosure. As shown in the figure, each of X*Y pixels P11 to Pxy includes the first color subpixels SP1, the second color subpixels SP2 and the third color subpixels SP3; subpixels corresponding to odd columns and odd rows receive first pixel voltages; subpixels corresponding to even columns and even rows receive first pixel voltages; subpixels corresponding to the odd columns and the even rows receive second pixel voltages; and subpixels corresponding to the even columns and the odd rows receive second pixel voltages.

Figure 4:
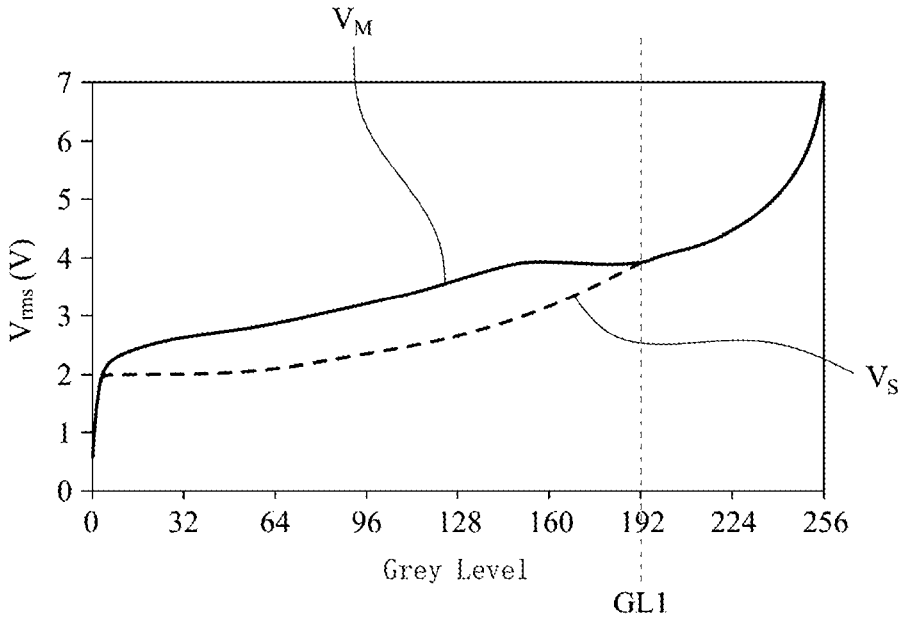
FIG. 4 is a schematic diagram of a curve of gray-level versus voltage according to an embodiment of the disclosure.

FIG. 4 is a schematic diagram of a curve of gray-level versus voltage according to an embodiment of the disclosure. In a display panel of the disclosure, two pixels (or two subpixels) that are located at a same column and at two adjacent rows separately receive a voltage from the first pixel voltages and a voltage from the second pixel voltages, respectively. Therefore, from the perspective of the overall frame image, two pixels (or two subpixels) that are located at a same column and at two adjacent rows are displayed with different brightness, and a brightness difference between the two pixels (or two subpixels) causes a stripe phenomenon on the frame image. Referring to FIG. 3A and FIG. 3B, any two adjacent pixels (or any two adjacent subpixels) in a display panel separately receive different pixel voltages, which might cause a broken color phenomenon when a frame image is displayed. In this situation, the display is unable to display the color that is intended. The foregoing problem causes poor user perception and reduced resolution.

In order to solve the foregoing problem, referring to FIG. 1B and FIG. 4 together, when all gray levels of a first color display data set received by a driver 100 happen to be identical to one another and higher than a threshold value GL1, the driver 110 provides identical pixel voltages to the X*Y pixels P11 to Pxy through data lines D1 to Dn. For example, when all gray levels of a first color display data set received by a first gamma lookup table (LUT1) 112 and a second gamma lookup table (LUT2) 114 of a driver 110 happen to be identical to one another and higher than or equal to a gray level of L192 (using a gray level range of L0 to L255 as an example in this embodiment), a first pixel voltage $V_M$ provided by the first gamma lookup table (LUT1) 112 is equal to a second pixel voltage $V_S$ provided by the second gamma lookup table (LUT2) 114, and in this way, adjacent pixels (subpixels) are displayed with a same brightness, so as to ameliorate the stripe phenomenon and color shift phenomenon introduced above, and improve the viewing experience of a user of the display panel. However, the disclosure is not limited to the foregoing threshold value, and the foregoing threshold value can be adaptively selected according to actual requirements when the disclosure is implemented.

Figure 5:
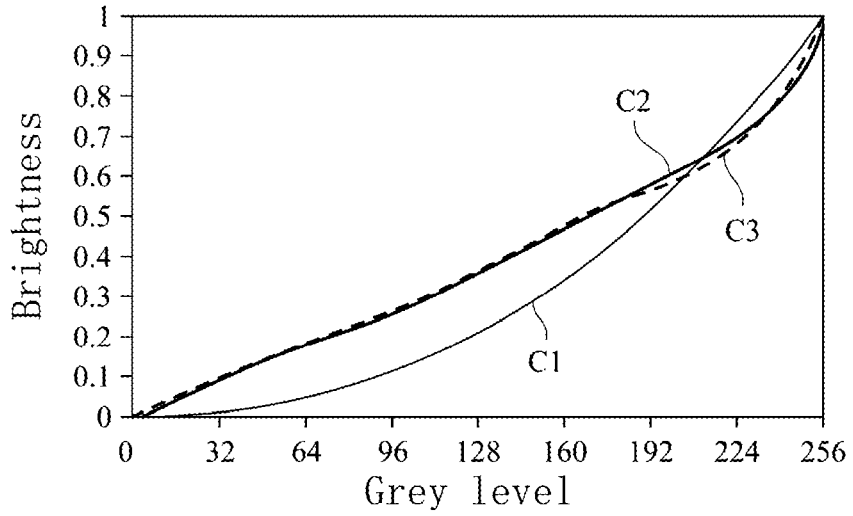
FIG. 5 is a data verification diagram of the embodiment shown in FIG. 4 according to another embodiment of the disclosure.

FIG. 5 is a data verification diagram of the embodiment shown in FIG. 4 according to another embodiment of the disclosure. As shown in the figure, a curve C1 is a brightness curve of a front view of a display panel; a curve C2 is a brightness curve of a side view of the display panel when different pixel voltages are adopted in the disclosure; and a curve C3 is a brightness curve of a side view of the display panel in a case in which pixel voltages are derived from the same gray level-to-voltage curve when a gray level is high in the disclosure. First, it can be deduced from a comparison between the curve C1 and the curve C2 that a difference between the curve C1 and the curve C2 is stable. Therefore, no matter whether the displayed colors are red, green, blue, or otherwise, the brightness levels synthesized by the curve C1 and the curve C2 are stable, and a situation in which any particular color is spuriously brighter is avoided. In this way, a color washout problem can be prevented. Second, it can be deduced from a comparison between the curve C2 and the curve C3 that even if the curve C3 indicates that the pixel voltages are derived from the same gray level-to-voltage curve when the gray level is high, the difference between the curve C3 and the curve C2 indicating that the pixel voltages are not adjusted is very small. Therefore, deriving the pixel voltages from the same gray level-to-voltage curve when the gray level is high can also solve the color washout problem, and can further improve a stripe phenomenon and a color shift phenomenon of an overall frame and improve viewing experience of a user on a display panel.

Figure 6:
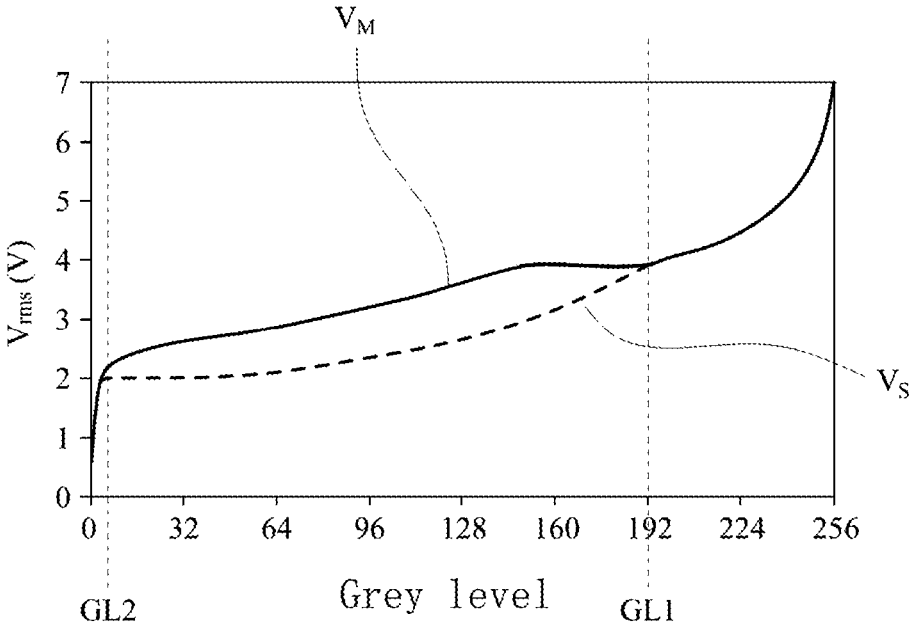
FIG. 6 is a schematic diagram of a curve of gray-level versus voltage according to yet another embodiment of the disclosure.

FIG. 6 is a schematic diagram of a curve of gray-level versus voltage according to yet another embodiment of the disclosure. To solve problems of the foregoing stripe phenomenon and color shift phenomenon of an overall frame, besides the manner of adjusting the pixel voltages to be derived from the same gray level-to-voltage curve when the gray level of the display is high as shown in FIG. 4, the pixel voltages can be further derived from the same gray level-to-voltage curve when the gray level of the display is low. Referring to FIG. 1B and FIG. 6 together, when all gray levels of a first color display data received by a driver 110 are lower than a threshold value GL2, the driver 110 provides an identical pixel voltage to the X*Y pixels P11 to Pxy through data lines D1 to Dn. For example, when all gray levels of a first color display data set received by a first gamma lookup table (LUT1) 112 and a second gamma lookup table (LUT2) 114 of a driver 110 are lower than or equal to a gray level of L32, a first pixel voltage $V_M$ provided by the first gamma lookup table (LUT1) 112 is equal to a second pixel voltage $V_S$ provided by the second gamma lookup table (LUT2) 114, and in this way, adjacent pixels (subpixels) are displayed with a same brightness, so as to improve a stripe phenomenon and a color shift phenomenon of an overall frame, and improve the viewing experience of a user of the display panel. In another embodiment, the foregoing threshold value may be a gray level of L5 (using a gray level range of L0 to L255 as an example in this embodiment). However, the disclosure is not limited to the foregoing threshold value, and the foregoing threshold value can be adaptively selected according to actual requirements when the disclosure is implemented.

Figure 7:
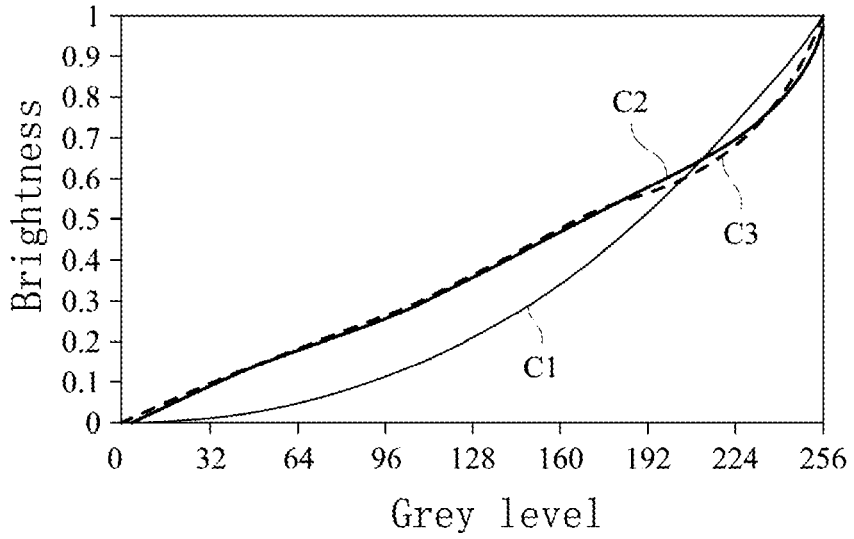
FIG. 7 is a data verification diagram of the embodiment shown in FIG. 6 according to still another embodiment of the disclosure.

FIG. 7 is a data verification diagram of the embodiment shown in FIG. 6 according to still another embodiment of the disclosure. As shown in the figure, a curve C1 is a brightness curve of a front view of a display panel; a curve C2 is a brightness curve of a side view of the display panel when different pixel voltages are adopted in the disclosure; and a curve C3 is a brightness curve of a side view of the display panel in a case in which pixel voltages are derived from the same gray level-to-voltage curve when a gray level is high or when a gray level is low in the disclosure. It should be noted that the comparison between the curve C1 and the curve C2 is described in the prior embodiment, and is not described herein again. Second, it can be deduced from a comparison between the curve C2 and the curve C3 that even if the curve C3 indicates that the pixel voltages are derived from the same gray level-to-voltage curve when the gray level is high or when the gray level is low, a difference between the curve C3 and the curve C2 indicating that the pixel voltages are not adjusted is very small. Therefore, it can be proved that a manner of adjusting the pixel voltages to be derived from the same gray level-to-voltage curve when the gray level is high or when the gray level is low in the disclosure can also help ameliorate the color washout problem, and can further improve a stripe phenomenon and a color shift phenomenon of an overall frame and improve viewing experience of a user on a display panel.

Figure 8:
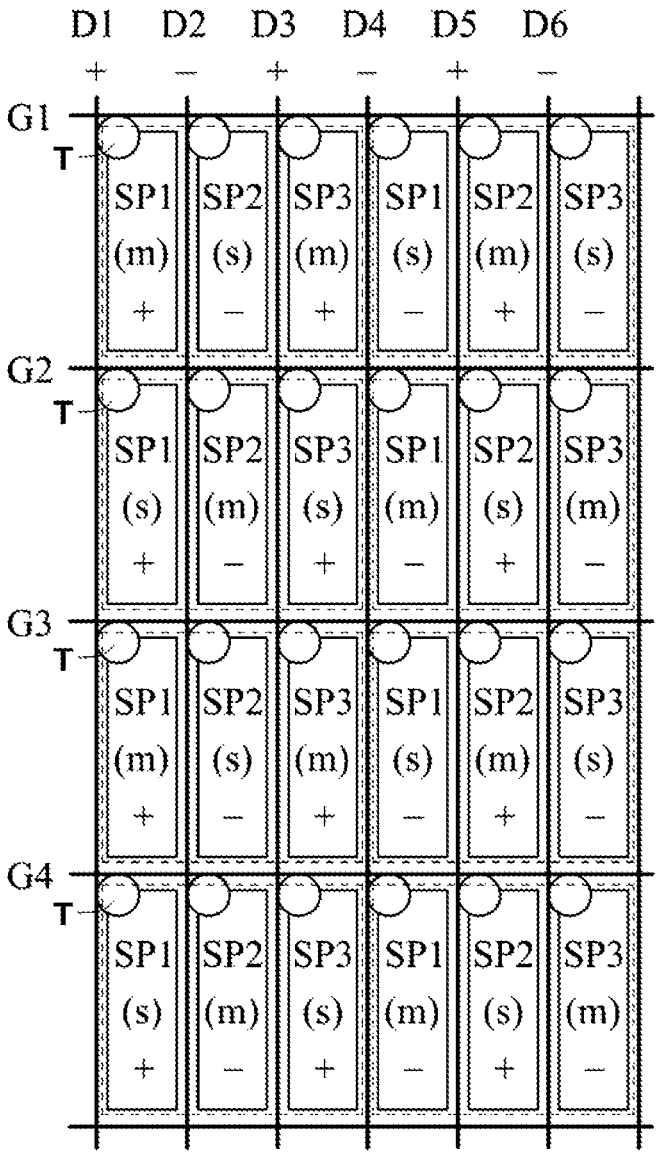
FIG. 8 is a schematic diagram of a display panel according to an embodiment of the disclosure.
Figure 9:
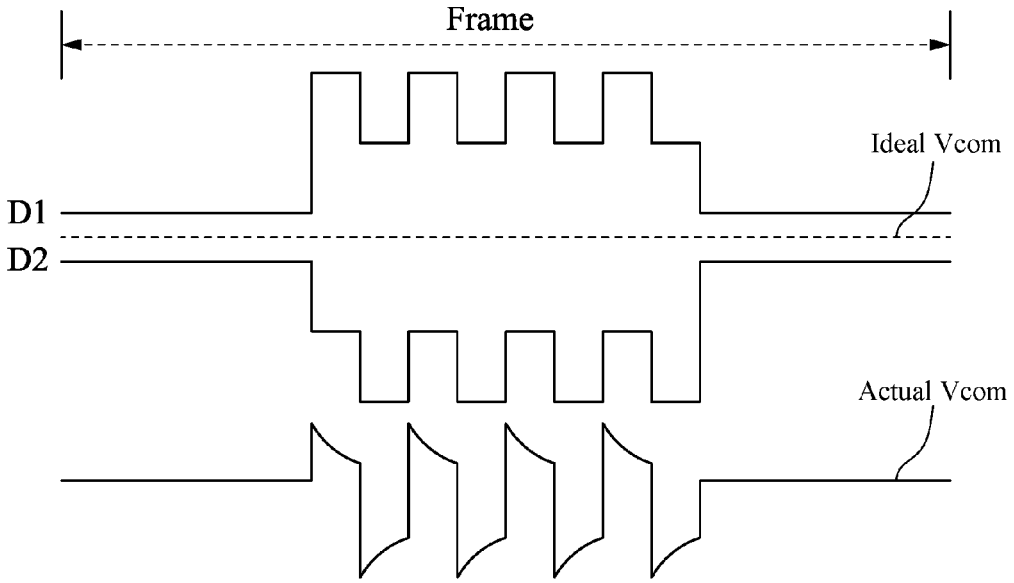
FIG. 9 is a schematic diagram of a data voltage and a reference voltage according to another embodiment of the disclosure.

FIG. 8 is a schematic diagram of a display panel according to an embodiment of the disclosure. FIG. 9 is a schematic diagram of data voltages and reference voltages according to another embodiment of the disclosure. It should be noted that an architecture of a display panel of FIG. 8 is similar to that of FIG. 3B. In order to make the specification of this application concise, the architecture of the display panel of FIG. 8 is not further described herein. In FIG. 8, it can be seen that polarities of main subpixels m in a same scan line are all the same polarities, and polarities of secondary subpixels s are all the same polarities. As for impacts of the foregoing phenomenon, refer to FIG. 9. First, an ideal common voltage Vcom should be maintained at a same voltage value as shown in FIG. 9. However, the polarities of the main subpixels m in the same scan line are all the same polarities, and therefore, once a data voltage provided by a data line D1 is changed to a high level, the common voltage Vcom is pulled towards the positive polarity, so that a voltage of the main subpixels m becomes smaller, and a voltage of the secondary subpixels s becomes larger, causing a gamma curve to change, so as to cause a horizontal crosstalk (H-Crosstalk) phenomenon.

In order to solve the foregoing problem, the disclosure performs different configurations on polarities of data voltages provided by data lines, so as to enable polarities of data signals received by main subpixels m in a same row to include a positive polarity and a negative polarity instead of including a same polarity only, so that a common voltage Vcom is maintained at a same voltage value, thereby further improving an H-Crosstalk phenomenon. Refer to the following FIG. 10A to FIG. 12A for a detailed polarity configuration manner of the data voltages.

Figures 10A, 10B:
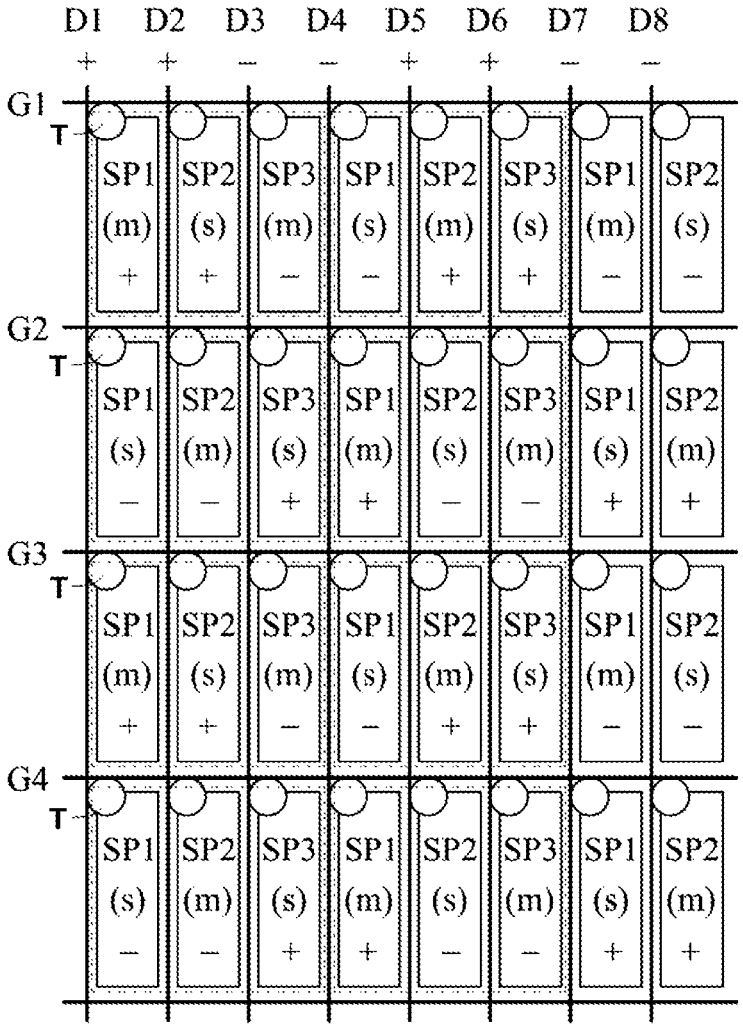
FIG. 10A is a schematic diagram of polarity configurations of data voltages according to yet another embodiment of the disclosure.
FIG. 10B is a schematic diagram of a display panel and polarities of subpixels thereof according to still another embodiment of the disclosure.

FIG. 10A is a schematic diagram of polarity configurations of data voltages according to yet another embodiment of the disclosure. As shown in the figure, polarities of data voltages provided by every four data lines are configured to be a positive polarity (+), a positive polarity (+), a negative polarity (−), and a negative polarity (−). Accordingly, in a same row, polarities of data signals received by a main subpixel m, a secondary subpixel s, a main subpixel m, and a secondary subpixel s are sequentially a positive polarity (+), a positive polarity (+), a negative polarity (−), and a negative polarity (−). FIG. 10B is a schematic diagram of a display panel and polarities of subpixels thereof according to still another embodiment of the disclosure, where polarities of adjacent subpixels in a same column may be different, but the disclosure is not limited thereto, and polarity conversion may be applied by every N rows. FIG. 10B shows a state of a display panel to which the polarity configurations of data voltages in FIG. 10A are applied. It can be seen from FIG. 10B that polarities of data signals received by main subpixels m in a same row include a positive polarity and a negative polarity instead of including a positive polarity only, so that a common voltage Vcom is maintained at a same voltage value, thereby further improving an H-Crosstalk phenomenon.

Figures 11A, 11B:
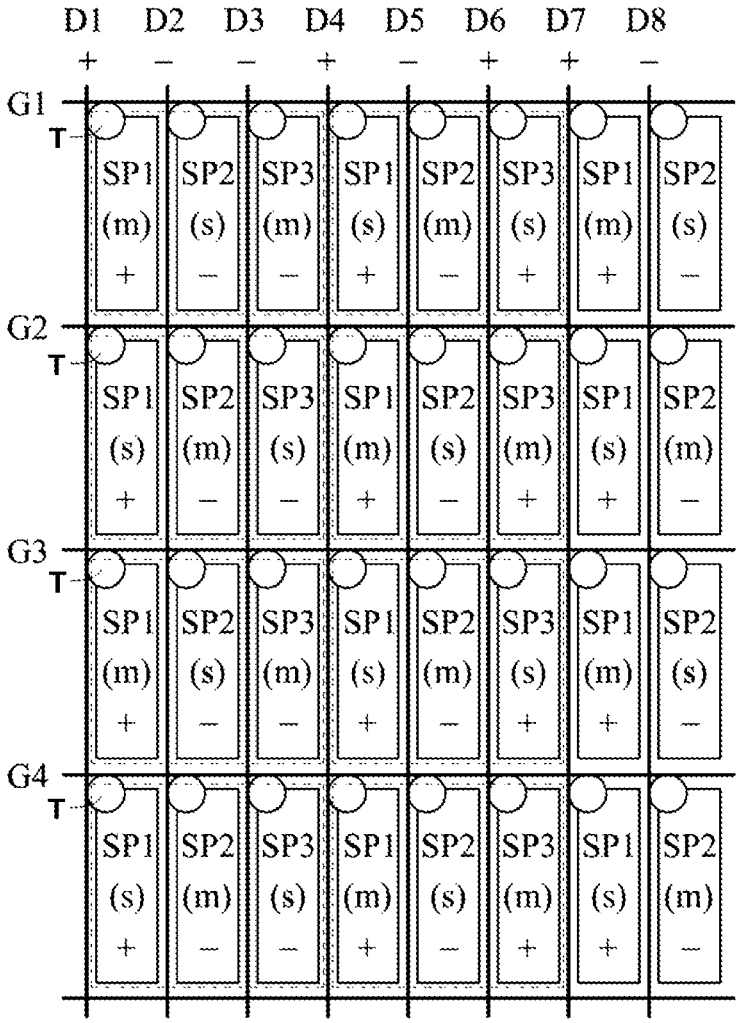
FIG. 11A is a schematic diagram of polarity configurations of data voltages according to another embodiment of the disclosure.
FIG. 11B is a schematic diagram of a display panel and polarities of subpixels thereof according to yet another embodiment of the disclosure.

FIG. 11A is a schematic diagram of polarity configurations of data voltages according to another embodiment of the disclosure. As shown in the figure, polarities of data voltages provided by every eight data lines are configured to be a positive polarity (+), a negative polarity (−), a negative polarity (−), a positive polarity (+), a negative polarity (−), a positive polarity (+), a positive polarity (+), and a negative polarity (−). Accordingly, in a same row, polarities of data signals separately received by main subpixels m and secondary subpixels s arranged in an interlaced manner are sequentially a positive polarity (+), a negative polarity (−), a negative polarity (−), a positive polarity (+), a negative polarity (−), a positive polarity (+), a positive polarity (+), and a negative polarity (−). FIG. 11B is a schematic diagram of a display panel and polarities of subpixels thereof according to yet another embodiment of the disclosure, where polarities of subpixels in a same column may change by every two rows, but the disclosure is not limited thereto, and polarity conversion may be applied by every N rows. FIG. 11B shows a state of a display panel to which the polarity configurations of data voltages in FIG. 11A are applied. It can be seen from FIG. 11B that polarities of data signals received by main subpixels m in a same row include a positive polarity and a negative polarity instead of including a positive polarity only, so that a common voltage Vcom is maintained at a same voltage value, thereby further improving an H-Crosstalk phenomenon.

Figures 12A, 12B:
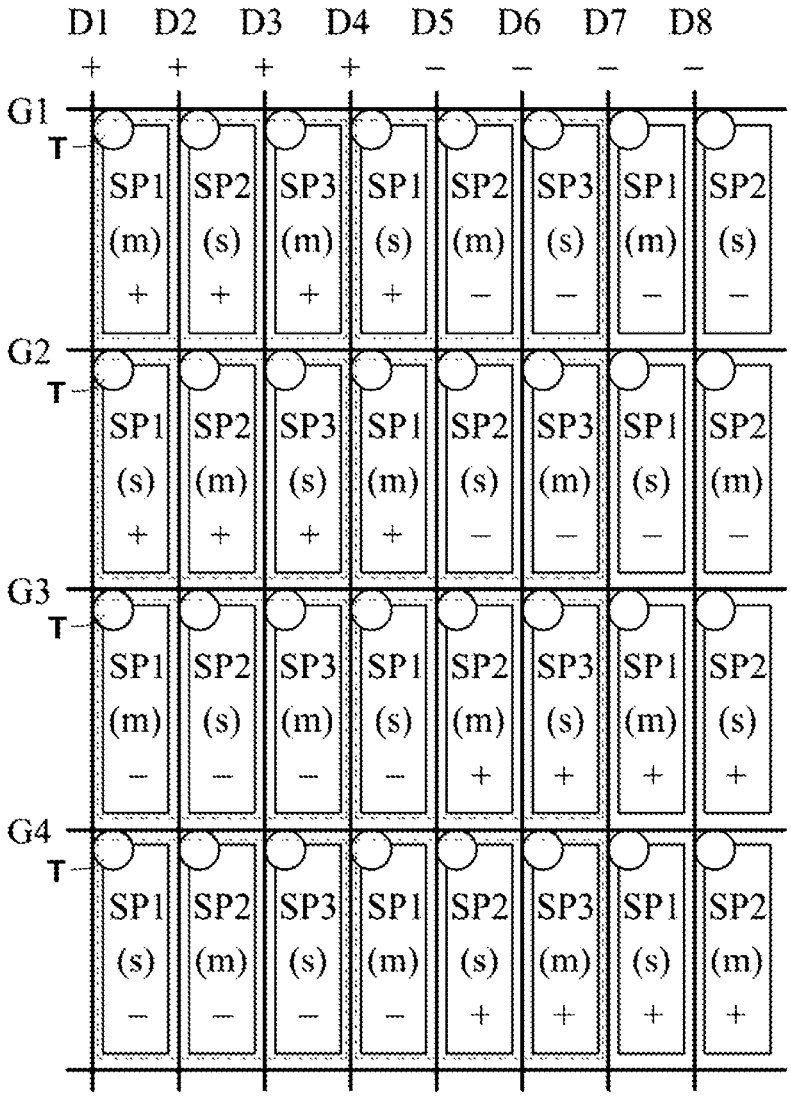
FIG. 12A is a schematic diagram of polarity configurations of data voltages according to still another embodiment of the disclosure.
FIG. 12B is a schematic diagram of a display panel and polarities of subpixels thereof according to another embodiment of the disclosure.

FIG. 12A is a schematic diagram of polarity configurations of data voltages according to still another embodiment of the disclosure. As shown in the figure, polarities of data voltages provided by every eight data lines are configured to be a positive polarity (+), a positive polarity (+), a positive polarity (+), a positive polarity (+), a negative polarity (−), a negative polarity (−), a negative polarity (−), and a negative polarity (−). Accordingly, in a same row, polarities of data signals separately received by main subpixels m and secondary subpixels s arranged in an interlaced manner are sequentially a positive polarity (+), a positive polarity (+), a positive polarity (+), a positive polarity (+), a negative polarity (−), a negative polarity (−), a negative polarity (−), and a negative polarity (−). FIG. 12B is a schematic diagram of a display panel and polarities of subpixels thereof according to another embodiment of the disclosure, where polarities of subpixels in a same column may change by every two rows, but the disclosure is not limited thereto, and polarity conversion may be applied by every N rows. FIG. 12B shows a state of a display panel to which the polarity configurations of data voltages in FIG. 12A are applied. It can be seen from FIG. 12B that polarities of data signals received by main subpixels m in a same row include a positive polarity and a negative polarity instead of including a positive polarity only, so that a common voltage Vcom is maintained at a same voltage value, thereby further improving an H-Crosstalk phenomenon.

In the embodiments of FIG. 10A to FIG. 12A, data lines at two sides of some subpixels are of the same polarity, for example, in FIG. 10A, data lines D1 and D2 are of the same polarity (+), and data lines D3 and D4 are of the same polarity (−), thus causing vertical crosstalk (V-Crosstalk). In order to improve the V-Crosstalk, the disclosure performs configuration on polarity conversion adopted by data lines, and refer to the following FIG. 13.

Figure 13:
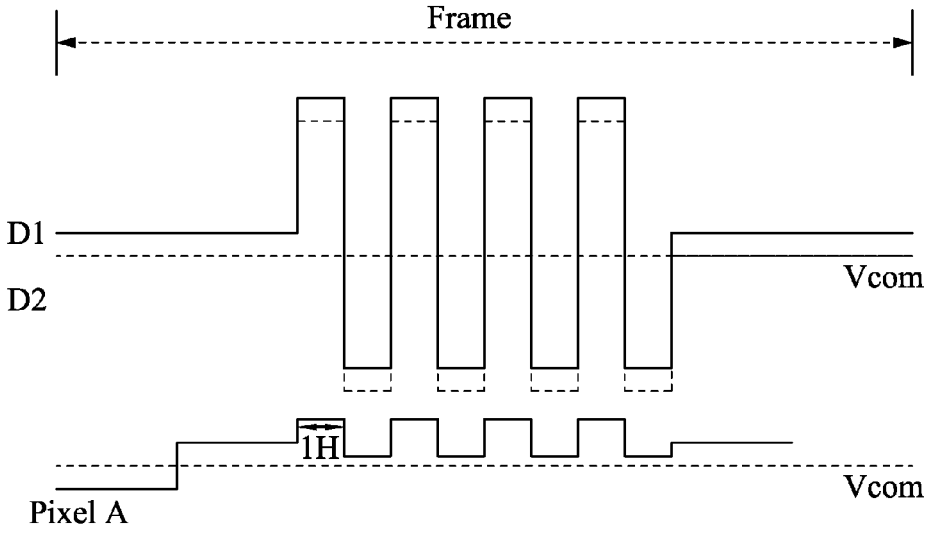
FIG. 13 is a schematic diagram of data voltages and reference voltages according to still another embodiment of the disclosure.

FIG. 13 is a schematic diagram of data voltages and reference voltages according to still another embodiment of the disclosure. As shown in the figure, a data line D1 and a data line D2 adopt dot polarity conversion, and data voltages provided by the data line D1 and the data line D2 are periodically converted between a positive polarity and a negative polarity. In a short time period, a voltage value of a common voltage Vcom at a specific time point may be slightly pulled up or pulled down, but, in view of a long time period, an average voltage of the common voltage Vcom remains unchanged. Hence, it can be known that a configuration manner of polarity conversion performed on data lines in the disclosure can surely solve the V-Crosstalk problem. In addition, a cycle of the dot polarity conversion should not be excessively long, so as to prevent a state of liquid crystals from being affected, and further prevent more display problems from being caused. The cycle of the dot polarity conversion adopted in the disclosure is lower than 1 millisecond (ms), and therefore, the average voltage of the common voltage Vcom can remain unchanged on the premise of not affecting the liquid crystals, so as to solve the V-Crosstalk problem. In an embodiment, the disclosure may adopt N-line dot polarity conversion. In order to prevent a cycle of the dot polarity conversion from being excessively long, and further prevent a state of liquid crystals from being affected, the disclosure may adopt 32-line dot polarity conversion or 64-line dot polarity conversion, so as to solve a V-Crosstalk problem. However, the disclosure is not limited to the foregoing value, and the foregoing value can be adaptively selected according to actual requirements when the disclosure is implemented. Furthermore, the first color, the second color and the third color in the abovementioned embodiments of the disclosure, preferred are different from each other, for example, red color, green color, and blue color, but not limited its. For example, the first color subpixel can be red color subpixel, the second color subpixel can be green color subpixel, and the third color subpixel can be blue color subpixel, but not limited its.

It can be seen from the foregoing description of the disclosure that application of the disclosure allows for a display panel that solves the side-view color washout, striping, color shift, H-crosstalk and V-crosstalk problems without the transmittance reduction problem of typical a subpixel area division technology.

Specific embodiments of the disclosure are disclosed in the above description, but are not intended to limit the disclosure to only these embodiments. A person of ordinary skill in the art can understand various variations and modifications to the embodiments without departing from the principle and spirit of the disclosure. Therefore, the protection scope of the disclosure should be subject to the scope defined by the claims.

What is claimed is:

1. A display panel, comprising:

a driver, for receiving display data with X×Y resolution, wherein X and Y are integers;

X data lines, electrically connected to the driver;

Y scan lines; and

X×Y pixels, electrically connected to the X data lines and the Y scan lines, said X×Y pixels comprising:

a plurality of first-color subpixels including a first first-color subpixel and a second first-color subpixel, wherein the first first-color subpixel and a second first-color subpixel are same color subpixels;

a plurality of second-color subpixels; and a plurality of third-color subpixels;

wherein each of the plurality of first-color subpixels, including the first first-color subpixel and the second first-color subpixel, receives display data with a same first gray level; and wherein when said first gray level is lower than a first threshold value, the first first-color subpixel receives a first pixel voltage, the first first-color subpixel and the second first-color subpixel each receives a different voltage, the second first-color subpixel receives a second pixel voltage, and the first pixel voltage is different from the second pixel voltage.

2. The display panel according to claim 1, wherein the driver further comprises:

a first gamma lookup table, separately receiving the display data and provide a plurality of first pixel voltages; and a second gamma lookup table, separately receiving the display data and provide a plurality of second pixel voltages.

3. The display panel according to claim 2, wherein pixels in odd rows receive the first pixel voltages, and pixels in even rows receive the second pixel voltages.

4. The display panel according to claim 2, wherein the first-color subpixels and the third-color subpixels in the odd rows receive the first pixel voltages, the second-color subpixels in the odd rows receive the second pixel voltages, the first-color subpixels and the third-color subpixels in the even rows receive the second pixel voltages, and the second-color subpixels in the even rows receive the first pixel voltages.

5. The display panel according to claim 2, wherein the X×Y pixels comprise a first pixel, a second pixel, a third pixel, and a fourth pixel arranged adjacent to each other in sequence, the first pixel and the fourth pixel receive the first pixel voltages, and the second pixel and the fourth pixel receive the second pixel voltages.

6. The display panel according to claim 2, wherein the first-color subpixels and the third-color subpixels receive the first pixel voltages, and the second-color subpixels receive the second pixel voltages.

7. The display panel according to claim 2, the X×Y pixels comprise a first pixel and a second pixel adjacent to each other, the first pixel receives the first pixel voltages, and the second pixel receives the second pixel voltages.

8. The display panel according to claim 2, wherein subpixels corresponding to odd columns and odd rows receive the first pixel voltages, subpixels corresponding to even columns and even rows receive the first pixel voltages, subpixels corresponding to the odd columns and the even rows receive the second pixel voltages, and subpixels corresponding to the even columns and the odd rows receive the second pixel voltages.

9. The display panel according to claim 1, wherein when the first gray level greater than the first threshold value or less than a second threshold value, the first pixel voltage equals to the second pixel voltage.

10. The display panel according to claim 8, wherein the first pixel voltages in a first row comprise a positive polarity and a negative polarity.

11. A method of operating a display panel, comprising:

providing a display driver for said display panel, wherein said display panel comprises a first set of subpixels and a second set of subpixels;

providing a first gray level-to-voltage lookup table and a second gray level-to-voltage lookup table in said display driver;

receiving gray level data corresponding to all subpixels of said display panel by said display driver;

outputting a first voltage and a second voltage from said first gray level-to-voltage lookup table and said second gray level-to-voltage lookup table to a first subpixel and a second subpixel of said first set of subpixels by said display driver according to said gray level data, wherein said first subpixel and said second subpixel are same color;

wherein both of said first subpixel and said second subpixel receive said gray level data with a first gray level; and wherein when said first gray level is lower than a first threshold value, the first pixel voltage is different from the second pixel voltage.

12. The method of claim 11, wherein said first set of subpixels are in odd pixel rows of said display panel, and said second set of subpixels are in even pixel rows of said display panel.

13. The method of claim 11, wherein each pixel of said display panel comprises a first subpixel, a second subpixel, and a third subpixel, and the first set of subpixels is the first subpixels and the third subpixels in odd pixel rows and the second subpixels in even pixel rows of said display panel, and the second set of subpixels is the first subpixels and the third subpixels in even pixel rows and the second subpixels in odd pixel rows of said display panel.

14. The method of claim 11, wherein said first set of subpixels comprises a first pixel and a second pixel adjacent to each, said second set of pixels comprises a third pixel adjacent to said first pixel opposite from said second pixel and a fourth pixel adjacent to said second pixel opposite from said first pixel.

15. The method of claim 11, wherein each pixel of said display panel comprises three subpixels, said first set of subpixels corresponds all subpixels in an even column and even row or in an odd column and odd row, and said second set of subpixels corresponds all subpixels in an even column and odd row or in an odd column and even row.

16. The method of claim 11, wherein when the first gray level greater than the first threshold value or less than a second threshold value, the first pixel voltage equals to the second pixel voltage.

17. The method of claim 11, wherein said first set of voltages comprises positive polarity voltages and a negative polarity voltages.

18. The display panel according to claim 1, wherein said first first-color subpixel and said second first-color subpixel are adjacent to each other, said first first-color subpixel is a primary first-color subpixel, and said second first-color subpixel is a secondary first-color subpixel.

19. The method of claim 11, wherein said first subpixel and said second subpixel are adjacent to each other.

* * * * *